US006758273B2

(12) United States Patent
Learned

(10) Patent No.: US 6,758,273 B2
(45) Date of Patent: Jul. 6, 2004

(54) LOW-FLOW GROUNDWATER SAMPLING SYSTEM

(76) Inventor: Richard B. Learned, P.O. Box 314, North Chatham, MA (US) 02650

( * ) Notice: Subject to any disclaimer, the term of this patent is extended or adjusted under 35 U.S.C. 154(b) by 0 days.

(21) Appl. No.: 10/083,015

(22) Filed: Feb. 26, 2002

(65) Prior Publication Data

US 2002/0157825 A1 Oct. 31, 2002

Related U.S. Application Data

(63) Continuation-in-part of application No. 09/883,068, filed on Jun. 15, 2001, now abandoned.
(60) Provisional application No. 60/211,947, filed on Jun. 16, 2000.

(51) Int. Cl.[7] ..... E21B 43/12
(52) U.S. Cl. ..... 166/264; 166/325; 166/332.4
(58) Field of Search ..... 166/373, 386, 166/316, 319, 325, 332.4, 264, 369

(56) References Cited

U.S. PATENT DOCUMENTS

| | | | | |
|---|---|---|---|---|
| 2,751,020 A | | 6/1956 | Johnston | |
| 3,163,225 A | | 12/1964 | Perkins | |
| 3,741,302 A | * | 6/1973 | Brown | 166/208 |
| 4,438,654 A | | 3/1984 | Torstensson | |
| 4,807,707 A | * | 2/1989 | Handley et al. | 175/20 |
| 5,046,568 A | * | 9/1991 | Cordry | 175/21 |
| 5,168,765 A | * | 12/1992 | Broussard | 73/864.74 |
| 5,301,561 A | * | 4/1994 | Karlsson | 73/864.74 |
| 5,460,224 A | * | 10/1995 | Schalla et al. | 166/264 |
| 5,485,881 A | | 1/1996 | Toon et al. | |
| 6,173,777 B1 | * | 1/2001 | Mullins | 166/285 |
| 6,343,650 B1 | * | 2/2002 | Ringgenberg | 166/250.17 |

FOREIGN PATENT DOCUMENTS

| | | |
|---|---|---|
| DE | 87 08 605 | 6/1987 |
| DE | 196 23 439 | 12/1997 |

OTHER PUBLICATIONS

Robert W. Puls and Michael J. Barcelona, Low–Flow (Minimal Drawdown) Ground–Water Sampling Procedures, EPA Ground Water Issue, Dec. 1995, EPA Publication No. EPA/540/S–95/504, Environmental Protection Agency.

* cited by examiner

*Primary Examiner*—Frank Tsay
(74) *Attorney, Agent, or Firm*—Iandiorio & Teska

(57) ABSTRACT

Methods, apparatus, and systems for low-flow sampling of a fluid source. One illustrative embodiment of the invention is directed to a method for manually sampling a fluid source in a well, including exerting a downward pressure on a sample tube, disposed within a well insert, to allow fluid to pass from the well through a portion of the well insert and into the sample tube to fill at least a portion of the sample tube with the fluid. Another illustrative embodiment of the invention is directed to a method for securing a well insert to an inner wall of a well, including arranging stabilizers on the well insert in a non-extended position, introducing the well insert into the well, arranging the stabilizers on the well insert in an extended position, and expanding a portion of a gasket on the well insert such that the portion of the gasket conforms to a circumference of the inner wall of the well.

24 Claims, 7 Drawing Sheets

LOW-FLOW GROUNDWATER SAMPLING SYSTEM

CROSS REFERENCE TO RELATED APPLICATION

This application is a Continuation-in-Part of application Ser. No. 09/883,068, filed Jun. 15, 2001, now abandoned, which application is hereby incorporated herein by reference and claims the benefit of Provisional Application No. 60/211,947, filed Jun. 16, 2000.

FIELD OF THE INVENTION

The present invention relates to methods, apparatus, and systems for low-flow sampling of a fluid source.

BACKGROUND OF THE INVENTION

The present invention relates to a well and groundwater sampling. Wells are used in the environmental and water supply industries, among other things, to collect samples of groundwater for chemical analysis. A typical well, shown in FIG. 1, is comprised of a slotted section of pipe 37 (the "well screen") located at the bottom of the well, a well point 39 which plugs the bottom of well screen 37 and sections of solid pipe 41 (the "riser pipe") which thread onto well screen 37 and each other to bring the well to a ground surface 49. The slots in well screen 37 are narrow enough (e.g., on the order of hundredths of an inch) to keep out soil particles, but allow in groundwater. The water level within a well having a portion of well screen 37 above a water table 43 (e.g., water table well 45) is the same as the level of water table 43 since atmospheric pressure alone is acting equally on both. If the entire well screen is located beneath water table 43 (e.g., in deep well 47), additional pressures, such as the weight of the water above, act on the groundwater. The pressures acting on a unit measure of groundwater are referred to as "head pressure." Groundwater will flow from areas of high head pressure to areas of low head pressure. Groundwater entering deep well 47 will usually flow upward into riser pipe 41 until it reaches equilibrium. The water level at equilibrium is sometimes referred to as the piezometric surface.

Since the water in a water table well is exposed to the atmosphere, it is not considered representative of groundwater outside the well screen. In a deep well, as a result of the water flowing into riser pipe 41 until equilibrium is reached, standing water may be present in the riser pipe between groundwater sampling events. This water may be present for weeks, months, or longer, and is also not considered representative of the groundwater outside of the well screen. In conventional systems, up to six volumes of standing water must be purged from the well. The purged water typically needs to be treated to remove contaminants before it can be discharged, which may require costly and time-intensive off-site treatment.

SUMMARY OF THE INVENTION

One illustrative embodiment of the invention is directed to a method for manually sampling a fluid source in a well, comprising an act of exerting a downward pressure on a sample tube, disposed within a well insert, to allow fluid to pass from the well through a portion of the well insert and into the sample tube to fill at least a portion of the sample tube with the fluid.

Another illustrative embodiment of the invention is directed to a method for securing a well insert to an inner wall of a well, comprising acts of arranging stabilizers on the well insert in a non-extended position; introducing the well insert into the well; arranging the stabilizers on the well insert in an extended position; and expanding a portion of a gasket on the well insert such that the portion of the gasket conforms to a circumference of the inner wall of the well.

A further illustrative embodiment of the invention is directed to an apparatus, comprising a well insert including a piston, the well insert being mounted to an inner surface of a well; and a sample tube, with means for activating the piston, disposed within the well insert.

Another illustrative embodiment of the invention is directed to an apparatus, comprising a well insert for insertion into a well; stabilizers mounted to the well insert, the stabilizers being movable from a non-extended position to an extended position such that when the stabilizers are in an extended position, the stabilizers extend to a location at or beyond a diameter of an inner wall of the well; and a gasket mounted to the well insert, the gasket being radially extendable from a non-extended position to an extended position such that when the gasket is in an extended position, the gasket conforms to a circumference of the inner wall of the well.

BRIEF DESCRIPTION OF THE DRAWINGS

The drawings are not intended to be drawn to scale. In the drawings, like elements have been given like reference characters.

DETAILED DESCRIPTION

One aspect of the present invention is directed to a method and apparatus for controlling the flow of groundwater into a deep well. Another aspect of the invention is directed to a method and apparatus for low-flow groundwater sampling within a water table or a deep well. Although these two aspects of the present invention are advantageously employed together in accordance with various illustrated embodiments of the invention, the present invention is not limited in this respect, as each of these aspects of the present invention can be employed separately.

Figure 1:
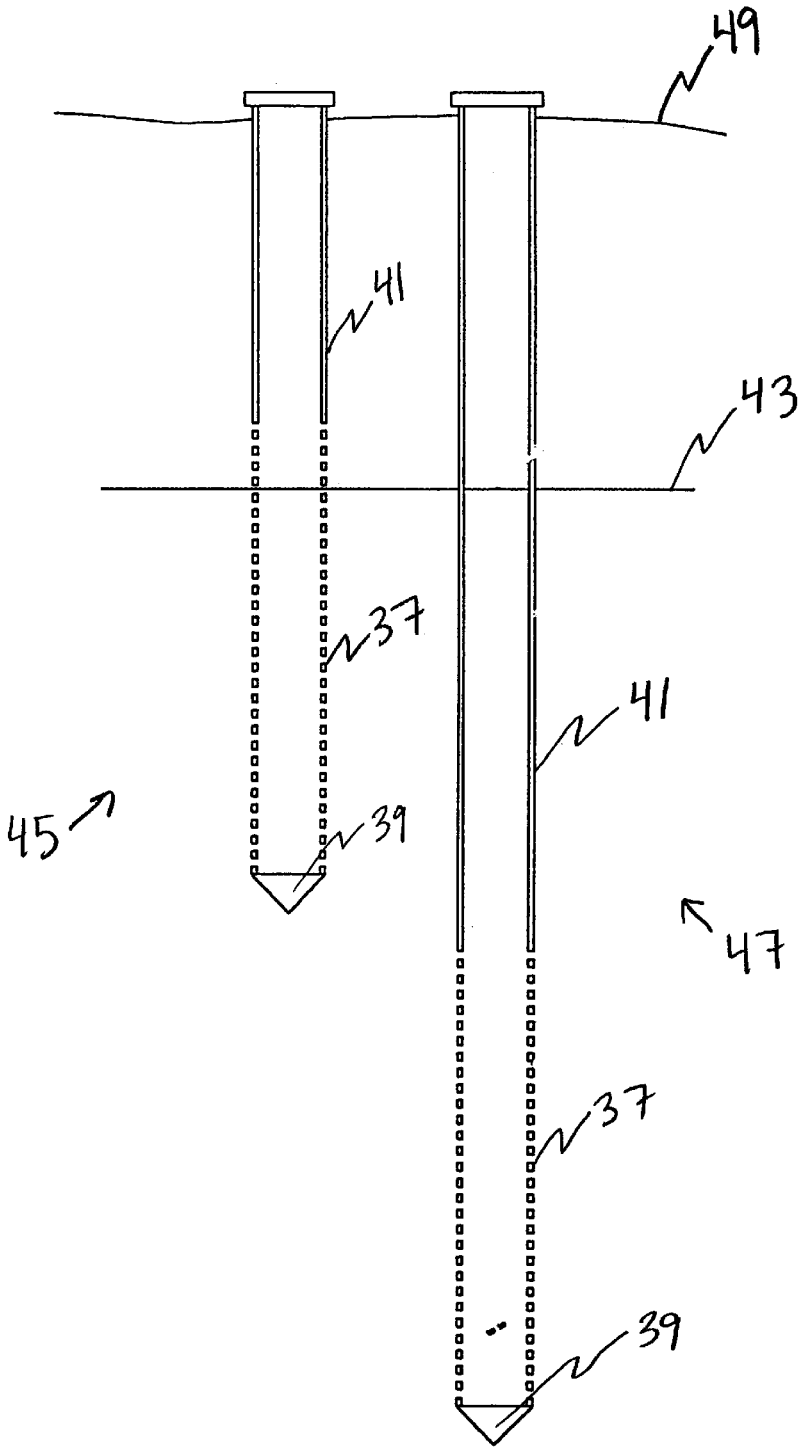
FIG. 1 is a cross-sectional view of a typical water table well and deep well.
Figure 2:
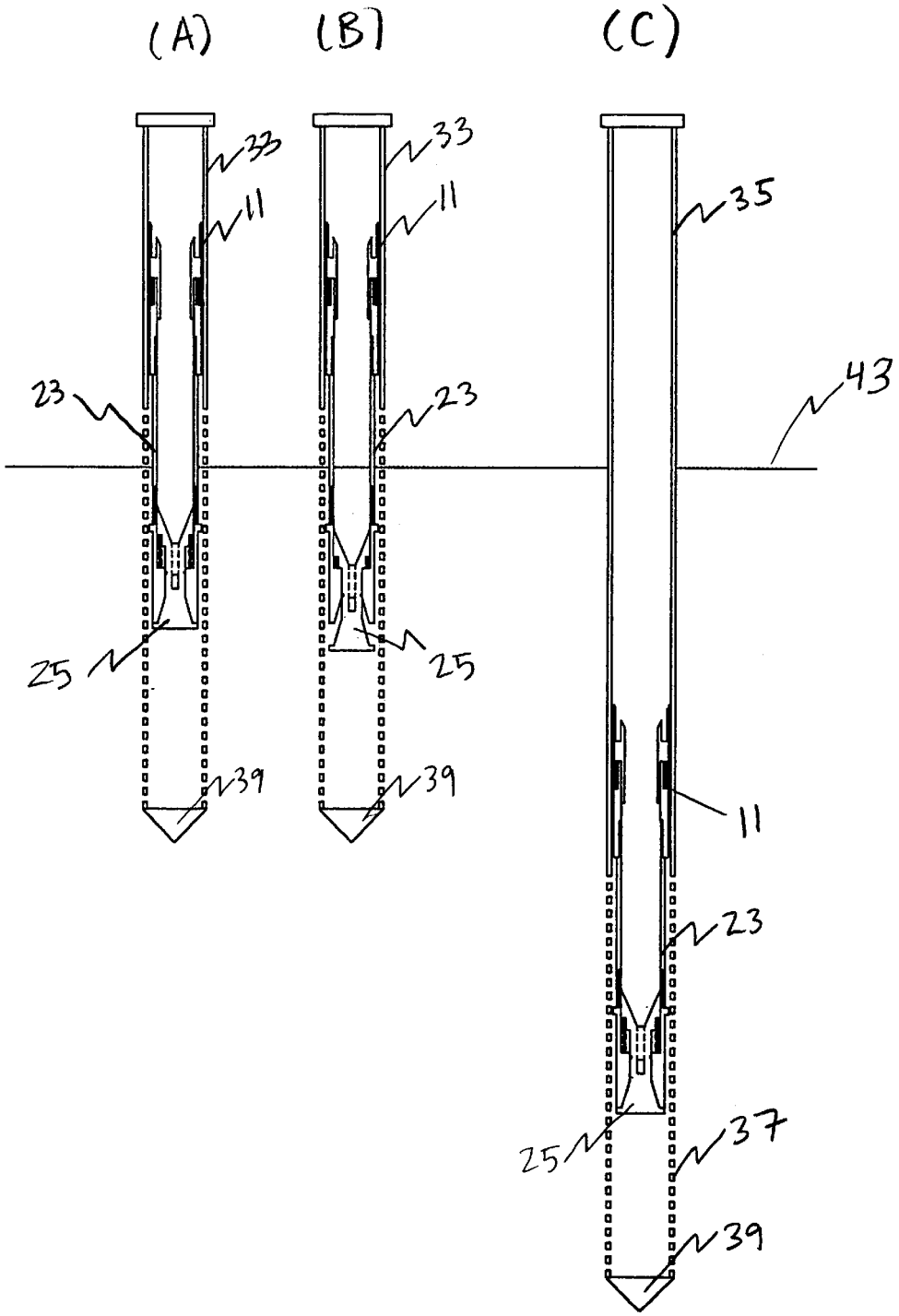
FIG. 2 is a cross-sectional view of a well insert according to an embodiment of the invention, shown in a water table well and deep well.

One illustrative embodiment of an apparatus for controlling the flow of groundwater into a well and sampling the groundwater within the well at a low flow rate is shown in FIGS. 2–7. FIG. 2 illustrates, from left to right: (A) a well insert 23, in a shallow well 33, having a piston 25 in an closed position; (B) well insert 23, in shallow well 33, having piston 25 in an open position; and (C) well insert 23, in a deep well 35, having piston 25 in a closed position. In the shallow well, a well screen 37 traverses water table 43, while gasket 11 is above water level 43. In the deep well, both well screen 37 and gasket 11 are submerged below water table 43. Aspects of the present invention are suited for use with both shallow and deep wells.

Figure 3:
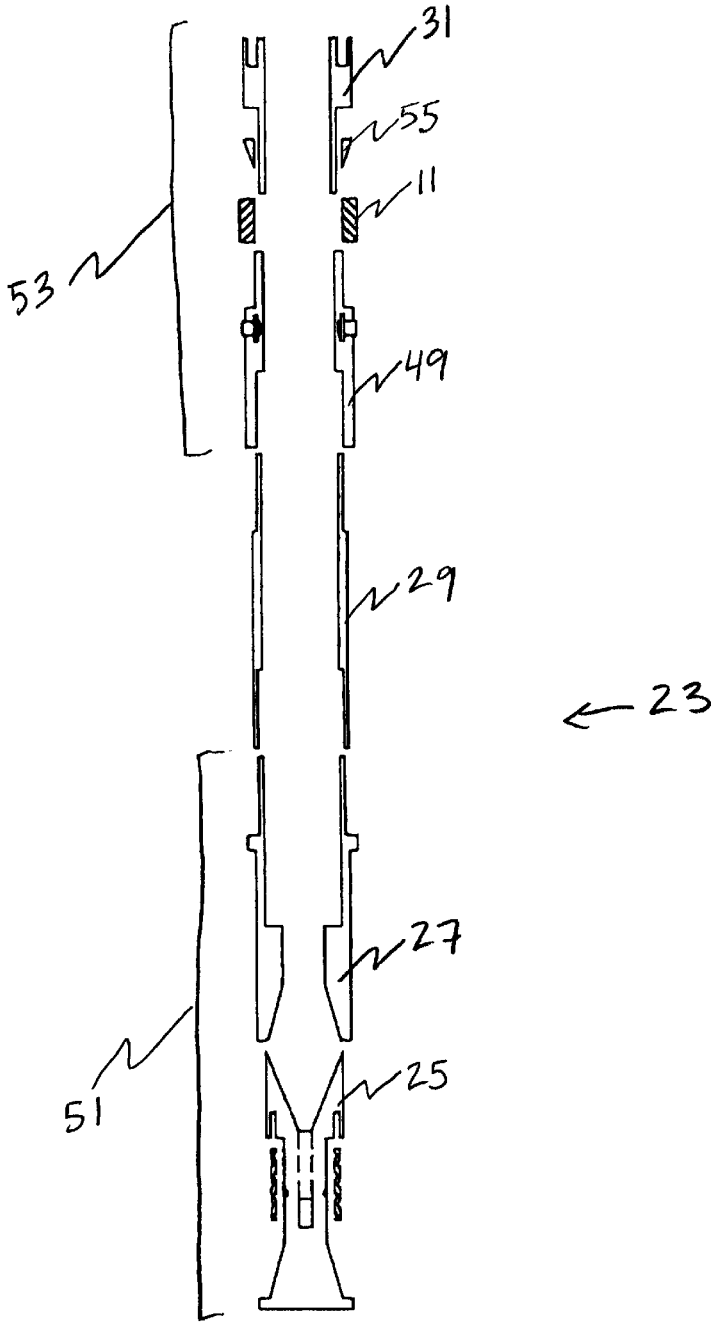
FIG. 3 is a cross-sectional view of component parts of the well insert of FIG. 2.

FIG. 3 illustrates an exploded view of well insert 23, which includes a lower portion 51 comprising a piston 25 and a piston housing 27; a middle portion 29 comprising a short length of pipe threaded on each end; and an upper portion 53 comprising gasket 11 and a housing assembly that includes an upper housing portion 31 and a lower housing portion 49. The lower portion 51 and upper portion 53 thread onto the middle portion 29 to produce well insert 23. O-rings (not shown) may be used at the interface between connecting elements to ensure a water-tight seal.

Figure 4:
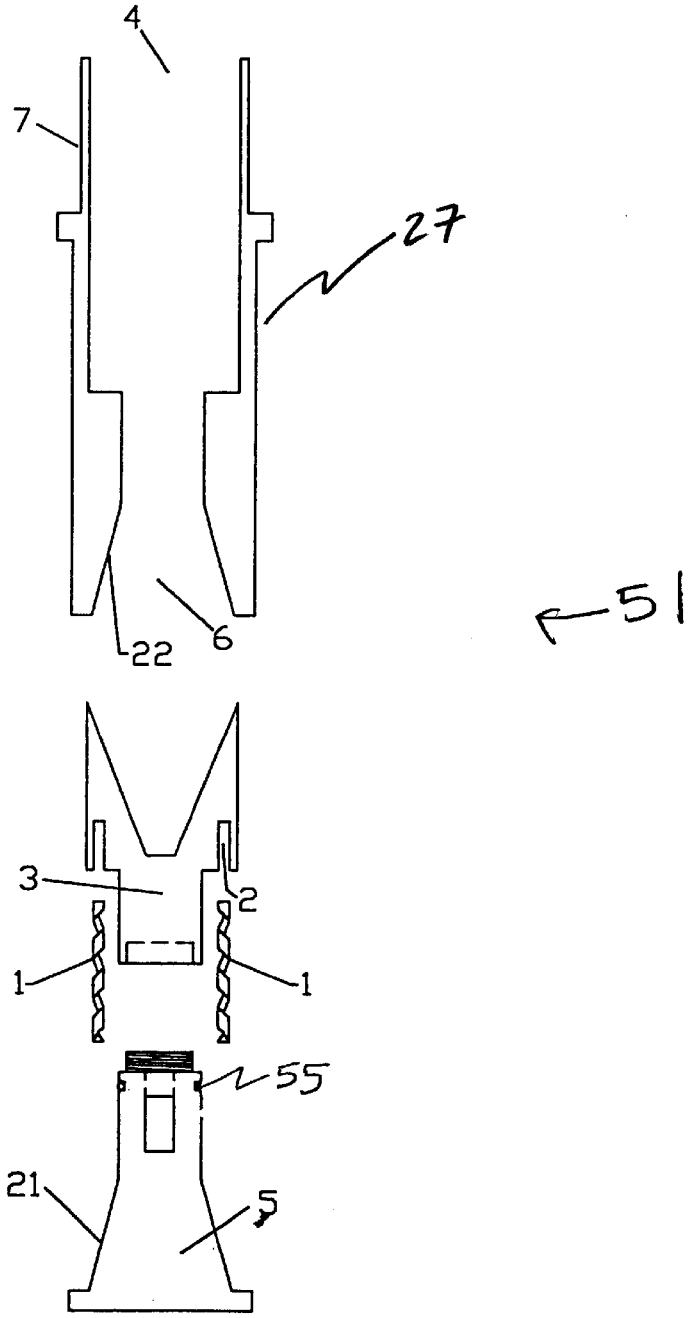
FIG. 4 is a cross-sectional view of component parts of the lower portion of the well insert of FIG. 2.

FIG. 4 illustrates an exploded view of the lower portion 51 of well insert 23. Lower portion 51 of well insert 23 is assembled by inserting a compression spring 1 into a groove 2 on the underside of a top 3 of piston 25, inserting compression spring 1 and top 3 of piston 25 into an opening 4 within a top 7 of piston housing 27, inserting a bottom 5 of piston 25 into an opening 6 within a conical section 22 of piston housing 27, and threading top 3 and bottom 5 of piston 25 together within piston housing 27. The lower portion 51 is then threaded onto middle portion 29, which is in turn attached to upper portion 53 by threading a bottom 8 of lower housing portion 49 (FIG. 5) onto middle portion 29, producing the well insert.

Figure 5:
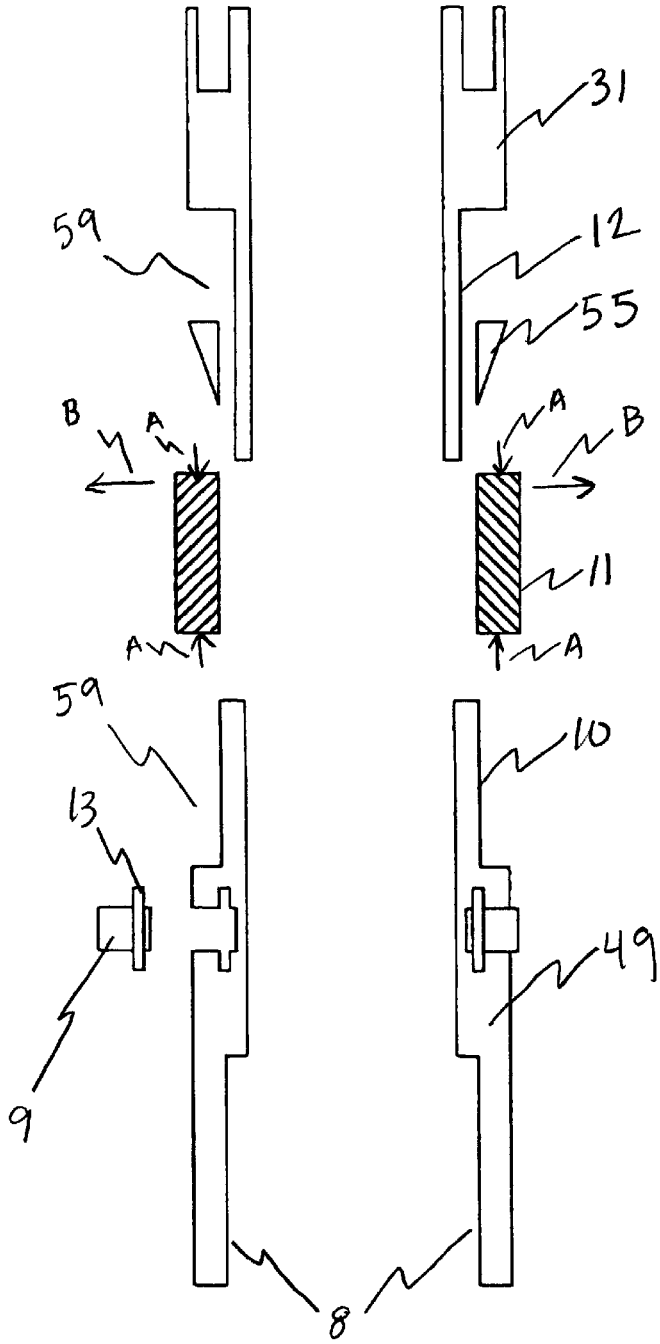
FIG. 5 is a cross-sectional view of component parts of the upper portion of the well insert of FIG. 2.

FIG. 5 illustrates an exploded view of the upper portion 53 of well insert 23, which includes upper housing portion 31 and lower housing portion 49, each threaded to allow for connection to the other. In particular, a bottom 12 of upper housing portion 31 is threaded to receive a top 10 of lower housing portion 49. As discussed above, when these are coupled together, they create a recess (i.e., gasket chamber 59) to house gasket 11 and an expander 55, which may be ring-shaped and be tapered. Tightening upper housing portion 31 and lower housing portion 49 reduces the distance between the housings. The reduction in size of the gasket chamber forces expander 55 between gasket 11 and a wall of gasket chamber 59, which compresses gasket 11 in the vertical, as shown by arrows A, and expands gasket 11 outward in the radial, as shown by arrows B. If well insert 23 is inserted into a well, the expanded gasket 11 will press against both the upper portion and the inner wall of the well. This pressure can be sufficient to secure the well insert within the well.

In addition to securing well insert 23 to the inner wall of the well, gasket 11 creates a seal that is substantially or fully impermeable to air and/or fluids (e.g., water) when in the expanded position. In a water table well, this seal isolates the groundwater from the air in the riser pipe, thereby substantially reducing the amount of volatilization that may occur within the well. In a deep well, the seal provides two advantages: 1) groundwater flowing into the screen is prevented from mixing with the "stagnant" water in the riser pipe; and 2) since the water in the riser pipe above the gasket can be removed, there is no cross-contamination of sampling equipment lowered into the well. In both the water table well and deep well examples, sealing the well at the top of the well screen results in less alteration of chemicals or chemical concentrations in groundwater as it flows through the well screen. Therefore, chemical analysis of groundwater in the well screen can be considered "representative" of the chemical makeup of groundwater in the aquifer.

An additional advantage provided by the air-tight and water-tight seal formed by gasket 11 is the prevention of contamination of a well by outside sources. Wells are susceptible to chemicals and other contaminants that may be introduced into the well, either by an environmental contamination or a deliberate act. These contaminants may infiltrate the well and surrounding ground, and thereby taint a large region of groundwater. Because the gasket described above is located below the surface of the ground, it is inaccessible to removal without proper equipment. Thus, the gasket serves to safeguard the well from accidental corruption or vandalism.

Figure 6:
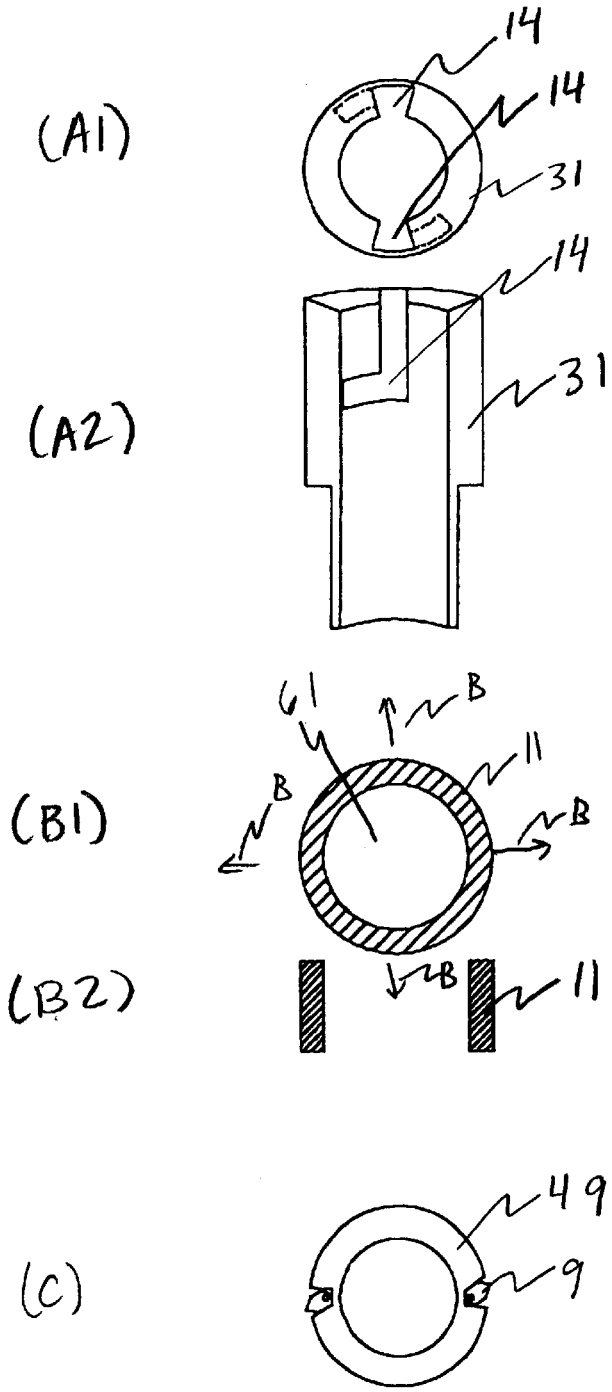
FIG. 6 shows a cross-sectional side view and top view of the stabilizer, gasket, and upper portion of the well insert of FIG. 2.

FIG. 6 shows from top to bottom: (A1) a top view of upper housing portion 31, (A2) a cross-sectional side view of upper housing portion 31, (B1) a top view of gasket 11, (B2) a cross-sectional side view of gasket 11, (C) and a cross-sectional top view of lower housing portion 49 with stabilizers 9. According to one embodiment of the invention, stabilizers 9 may be used to secure the well insert to the inner wall of a well before expansion of gasket 11. Stabilizers 9 may be recessed into lower housing portion 49 and may pivot on stainless steel pins 13. Stabilizers 9 may be made from stainless steel and may be wedge-shaped. The diameter of lower housing portion 49 across stabilizers 9, when the stabilizers 9 are pivoted (e.g., counterclockwise), is slightly larger than the inner diameter of the well. When the well insert is situated within the well, clockwise rotation causes stabilizers 9 to "catch" on the sides of the well, preventing the lower housing portion 49 from turning. This allows upper housing portion 31 to tighten, forcing expander 55 (FIG. 5) into an opening 61 of gasket 11, and in turn forcing the gasket to expand radially in the direction of arrows B against the inner wall of the well to secure the well insert in place. The well insert may be installed in a well by lowering it downward on extension rods (not shown) until the gasket is located just above the well screen. A turning tool (not shown) connected to the end of an extension rod may fit into grooves 14 cut into the top of upper housing portion 31. The turning tool may be locked into grooves 14 by a spring attached to the bottom of the tool.

Figure 7:
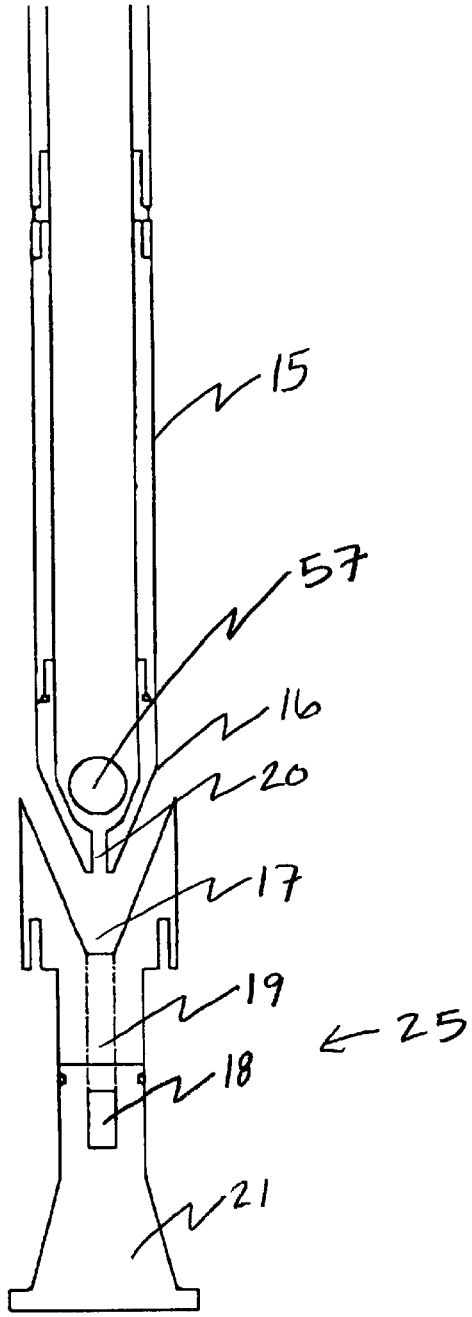
FIG. 7 is a cross-sectional view of the piston of the well insert of FIG. 2 and a sample tube.

FIG. 7 illustrates a sample tube 15 having flow-control point 16. To collect a groundwater sample, sample tube 15 is lowered into the well until flow-control point 16 is seated in a conical point chamber 17 located at the top of piston 25. Downward pressure on the sample tube overcomes compression spring 1 (FIG. 4), allowing the piston to extend into the groundwater and expose holes 18 in the shaft of piston 25, which are otherwise occluded by piston housing 27 (FIG. 4). The head pressure at the holes forces groundwater to flow into holes 18 and through a hollow center 19 of piston 25, through a hole 20 in flow-control point 16, and into sample tube 15. A free floating check ball 57 may be provided, which is displaced from hole 20 when fluid flows into sample tube 15. Check ball 57 returns to its original position covering hole 20 when sample tube 15 is removed from the well, and thereby prevents fluid from escaping sample tube 15 via hole 20. The rate of flow of groundwater into the sample tube is controlled by the size of hole 20. A rate of flow that is close to the natural rate of flow of water entering the well is desirable, as a low rate of flow is less likely to disturb sediment that may contaminate the groundwater in sample tube 15. Groundwater continues to flow into sample tube 15 until the downward pressure is released, causing compression spring 1 to retract piston 25 into the piston housing by seating conical section 21 of piston 25 against a conical section 22 of piston housing 27 (FIG. 4). The retraction of piston 25 within the piston housing creates a water-tight seal by occluding holes 18. Water may alternatively cease to flow into sample tube 15 when the water level in sample tube 15 equilibrates. Once a sample has been obtained, sample tube 15 can be removed from the well.

Above-described aspects of the present invention are advantageous because they may: 1) isolate the water in the well screen from either the air in the riser pipe in a water table well or the stagnant water in the riser pipe in a deep well, 2) control the flow of groundwater into a deep well, and 3) allow collection of a groundwater sample at a very low rate of flow. The first advantage has been previously discussed. The second and third relate to purging the well. Conventional sampling protocol calls for removing up to 6 well volumes prior to collecting a sample. This procedure is referred to as purging the well, and the purpose is to remove any chemically altered water in the well, bringing water from the aquifer into the well. Purging adds a significant expense to sample collection since it is time consuming, and purge water needs to be collected and treated to remove any contaminants before it can be discharged back to the environment. The United States Environmental Protection Agency (the "USEPA") has recently documented collecting groundwater at low-flow rates (0.1 to 0.5 milliliters per minute, "mL/min") to avoid disturbing the water column, which can introduce particulate matter or colloids into the well. These can attract contaminants that would be included in analysis of the water resulting in an unrepresentative measurement of contaminant concentrations in the sample. Dedicated sample apparatus and low-flow sampling protocol can minimize the disturbance of the water column during sampling. Part and parcel with low-flow sampling is the concept of "no-purge". This states that groundwater flowing through the well screen can be considered representative if the water column is not disturbed during sample collection, thus eliminating the need to purge the well prior to collecting a sample. The present invention allows both low-flow and no-purge sampling capability. The rate of flow into the sample tube is controlled by the diameter of the hole through the flow-control point with diameters less than ⅛ inch producing flow rates less then 1 mL/min. Purging is not required in a well having a well insert according to the present invention, since the well insert can be permanently installed in the well, thereby eliminating any disturbances to the water column which can result from the installation of a sampling system (e.g., a submersible pump or bailer) at the time of sampling, and since the gasket of the well insert seals the well screen from air or water in the riser pipe.

The present invention may be implemented without pumps, which advantageously reduces the cost of the sampling apparatus. Further, the well insert may be retained in the well between sampling events, which eliminates the need of constructing and deconstructing the sampling apparatus between events. Retaining the well insert between sampling events also allows the gasket to protect the well from exposure to air and potential contamination between sampling.

It should be appreciated that although the invention has been described in the context of sampling groundwater, other fluids may alternatively be sampled according to the invention. It should further be appreciated that the materials noted for use in the apparatus described are given for example only. The well insert and sample tube may be made from a number of plastics, metals, and other materials that are relatively impermeable and unreactive to water. Similarly, the gasket may be made from plastic, rubber, and other materials that are relatively impermeable and unreactive to water, and may have a cylindrical shape or disk shape, for example.

Having thus described several illustrative embodiments of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. A method for securing a well insert to an inner wall of a well, comprising acts of:

arranging stabilizers on the well insert in a non-extended position;

introducing the well insert into the well;

arranging the stabilizers on the well insert in an extended position; and expanding a portion of a gasket on the well insert such that the portion of the gasket conforms to a circumference of the inner wall of the well.

2. The method of claim 1, wherein the act of arranging the stabilizers on the well insert in an extended position includes rotating the well insert within the well.

3. The method of claim 1, wherein the act of expanding a portion of a gasket includes expanding the gasket in a radial direction and compressing the gasket in a vertical direction.

4. The method of claim 3, wherein the act of expanding a portion of a gasket includes inserting an expander into an opening of the gasket.

5. An apparatus, comprising:

a well insert for insertion into a well;

stabilizers mounted to the well insert, the stabilizers being movable from a non-extended position to an extended position such that when the stabilizers are in an extended position, the stabilizers extend to a location at or beyond a diameter of an inner wall of the well; and a gasket mounted to the well insert, the gasket being radially extendable from a non-extended position to an extended position such that when the gasket is in an extended position, the gasket conforms to a circumference of the inner wall of the well.

6. A method for manually sampling a fluid source in a well, the method comprising:

exerting downward pressure on a sample tube, disposed within a well insert, to allow fluid to pass from the well through a portion of the well insert and into the sample tube to fill at least a portion of the sample tube with the fluid, wherein the act of exerting downward pressure includes exerting a downward pressure on the sample tube to allow fluid to pass from the well into a piston of the well insert.

7. The method of claim 6 wherein the act of exerting downward pressure includes compressing at least one spring attached to the well insert.

8. The method of claim 6 wherein the act of exerting downward pressure includes exposing one or more openings in the piston though which fluid may flow.

9. The method of claim 6 wherein the act of exerting downward pressure on the sample tube includes exerting downward pressure on the sample tube, disposed within the well insert, to allow fluid to pass from the well through a portion of the well insert and into the sample tube to fill at least a portion of the sample tube with the fluid at a controlled rate.

10. The method of claim 6 further comprising releasing the downward pressure on the sample tube to prevent fluid from entering the sample tube.

11. The method of claim 6 further comprising securing the well insert to the inner surface of the well so as to form a barrier that is impermeable to air or fluids.

12. The method of claim 6 wherein the act of exerting downward pressure on the sample tube includes exerting downward pressure on the sample tube, disposed within the well insert, to allow fluid to pass from the well through a portion of the well insert and into the sample tube to fill at least a portion of the sample tube.

13. A method for manually sampling a fluid source in a well, the method comprising:

exerting downward pressure on a sample tube, disposed within a well insert, to allow fluid to pass from the well through a portion of the well insert and into the sample tube to fill at least a portion of the sample tube with the fluid; and releasing the downward pressure on the sample tube to prevent fluid from entering the sample tube.

14. A method for manually sampling a fluid source in a well, the method comprising:

exerting downward pressure on a sample tube, disposed within a well insert, to allow fluid to pass from the well through a portion of the well insert and into the sample tube to fill at least a portion of the sample tube with the fluid; and securing the well insert to the inner surface of the well so as to form a barrier that is impermeable to air or fluids.

15. The method of claim 14 wherein the act of exerting downward pressure on the sample tube includes exerting a downward pressure on the sample tube, disposed within the well insert, to allow fluid to pass from the well through a portion of the well insert and into the sample tube to fill at least a portion of the sample tube.

16. A method for manually sampling a fluid source in a well, the method comprising:

exerting downward pressure on a sample tube, disposed within a well insert, to allow fluid to pass from the well through a portion of the well insert and into the sample tube to fill at least a portion of the sample tube with the fluid; and wherein the act of exerting downward pressure on the sample tube includes exerting a downward pressure on the sample tube, disposed within the well insert, to allow fluid to pass from the well through a portion of the well insert and into the sample tube to fill at least a portion of the sample tube with the fluid at a controlled rate less than or equal to 1 mL/min.

17. An apparatus comprising:

a well insert including a piston and a gasket releasably sealing the well insert with respect to a well, the well insert being mounted to an inner surface of the well; and a sample tube for activating the piston disposed within the well insert.

18. The apparatus of claim 17 wherein the gasket is impermeable to air or fluids.

19. The apparatus of claim 18 wherein the well includes a screen and the gasket is mounted to an inner surface of the well that is in close proximity to the screen.

20. An apparatus comprising:

a well insert including a piston, the well insert being mounted to an inner surface of a well; and a sample tube, for activating the piston, disposed within the well insert, and including an opening having a diameter that is selected based on a desired rate at which fluid may enter the sample tube.

21. An apparatus comprising:

a well insert including a piston, the well insert being mounted to an inner surface of a well; and a sample tube, for activating the piston, disposed within the well insert, wherein the piston includes one or more openings that allow fluid to pass when the piston is activated by the sample tube, and do not allow fluid to pass when the piston is not activated by the sample tube.

22. A method of sampling in a well including a well screen and a riser pipe comprising:

inserting a well insert with a lower piston into the riser pipe;

sealing the well insert with respect to the riser pipe;

inserting a sample tube into the well insert;

exerting downward pressure on the sample tube to activate the piston and to allow fluid to pass into the sample tube; and withdrawing the sample tube from the well insert.

23. An apparatus for withdrawing a sample fluid from a well including a well screen and a riser pipe, the apparatus comprising:

a well insert including a piston;

a seal between the well insert and the riser pipe; and a sample tube insertable in the well insert which activates the piston of the well insert to allow fluid to pass into the sample tube for sampling.

24. An apparatus comprising:

a well insert including a radially expandable gasket which, when expanded, seals the well insert with respect to a well and which, when retracted, allows the well insert to be disposed in the well; and an expander for expanding the gasket to seal the well insert with respect to the well after the well insert is disposed in the well.

* * * * *